US010655559B2

(12) United States Patent
Knollmayr

(10) Patent No.: US 10,655,559 B2
(45) Date of Patent: May 19, 2020

(54) CYLINDER HEAD FOR AN INTERNAL COMBUSTION ENGINE

(71) Applicant: AVL LIST GMBH, Graz (AT)

(72) Inventor: Christof Knollmayr, Graz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 15/570,076

(22) PCT Filed: May 4, 2016

(86) PCT No.: PCT/AT2016/050127

§ 371 (c)(1),
(2) Date: Oct. 27, 2017

(87) PCT Pub. No.: WO2016/176710

PCT Pub. Date: Nov. 10, 2016

(65) Prior Publication Data

US 2018/0106213 A1 Apr. 19, 2018

(30) Foreign Application Priority Data

May 7, 2015 (AT) ..... A 50376/2015

(51) Int. Cl.
*F02F 1/36* (2006.01)
*F02F 1/40* (2006.01)
(Continued)

(52) U.S. Cl.
CPC ..... *F02F 1/40* (2013.01); *F01P 3/02* (2013.01); *F02F 1/243* (2013.01); *F02F 1/36* (2013.01);
(Continued)

(58) Field of Classification Search
CPC ..... F02F 1/40; F02F 1/243; F01P 2003/024; F01P 3/02; F01P 3/14
(Continued)

(56) References Cited

U.S. PATENT DOCUMENTS 5,970,926 A 10/1999 Tsunoda et al.
7,051,685 B2 5/2006 Hayman et al.
(Continued)

FOREIGN PATENT DOCUMENTS

AT 500442 6/2008
DE 69910249 4/2004
(Continued)

OTHER PUBLICATIONS

English Abstract of DE102005050510.
(Continued)

*Primary Examiner* — Long T Tran
*Assistant Examiner* — James J Kim
(74) *Attorney, Agent, or Firm* — Dykema Gossett PLLC

(57) ABSTRACT

The invention relates to a cylinder head (4) for an internal combustion engine having liquid cooling, comprising at least two outlet valves for controlling outlet openings (14) and at least one inlet valve for controlling at least one inlet opening (15) per cylinder (2), having at least one cooling jacket (3) through which coolant flows. An outlet valve bridge (7) is arranged between two adjacent outlet valves and an inlet/outlet valve bridge (8) is arranged in each case between at least one outlet valve and an adjacent inlet valve. A first cooling channel (18) is arranged in the region of at least one outlet valve bridge (7), and a second cooling channel (19) is arranged in the region of at least one inlet/outlet valve bridge (8), and the first and second cooling channels (18, 19) are fluidically connected to one other in a central cooling region (20) of the cylinder (2) with one another. According to the invention, in order to improve the cooling in the region of the inlet/outlet valve bridges and in the region of the outlet valve guides, at least one second cooling channel (19) has a flow dividing arrangement (21) which sub-divides the second cooling channel (19) into a
(Continued)

first part-channel (19*a*) and a second part-channel (19*b*), wherein preferably the first part-channel (19*a*) is arranged in the region of an outlet valve guide (14*a*) and the second part-channel (19*b*) is arranged in the region of an outlet valve seat (14*b*) of the adjacent outlet valve.

19 Claims, 2 Drawing Sheets

(51) Int. Cl.
*F01P 3/02* (2006.01)
*F02F 1/24* (2006.01)
*F02F 1/42* (2006.01)

(52) U.S. Cl.
CPC ..... *F02F 1/4214* (2013.01); *F01P 2003/024* (2013.01)

(58) Field of Classification Search
USPC ..... 123/41.82 R
See application file for complete search history.

(56) References Cited

U.S. PATENT DOCUMENTS

| | | | | |
|---|---|---|---|---|
| 7,234,422 | B2 * | 6/2007 | Schlautman | F02F 1/40 123/41.74 |
| 8,151,743 | B2 * | 4/2012 | Reustle | B22D 15/02 123/41.76 |
| 8,662,028 | B2 | 3/2014 | Knollmayr | |
| 8,875,670 | B2 * | 11/2014 | Brewer | F01N 13/105 123/41.82 R |
| 9,562,493 | B2 * | 2/2017 | Wakiya | |
| 2005/0087154 | A1 | 4/2005 | Hayman et al. | |
| 2009/0126659 | A1 * | 5/2009 | Lester | F01N 3/046 123/41.72 |
| 2010/0242869 | A1 * | 9/2010 | Knollmayr | F01P 3/02 123/41.82 R |
| 2011/0315098 | A1 * | 12/2011 | Kosugi | B22C 9/103 123/41.74 |
| 2013/0192546 | A1 * | 8/2013 | Ruffing | F02F 1/40 123/41.76 |

FOREIGN PATENT DOCUMENTS

| | | | | |
|---|---|---|---|---|
| DE | 102005050510 | | 4/2007 | |
| DE | 102008047185 | | 4/2010 | |
| DE | 102008047185 | A1 * | 4/2010 | F02F 1/40 |
| DE | 102008047185 | A1 * | 4/2010 | F02F 1/40 |
| EP | 1884647 | | 2/2008 | |
| JP | 2002256966 | | 9/2002 | |

OTHER PUBLICATIONS

English Abstract of JP2002256966.
English Abstract of DE102008047185.
English Abstract of EP1884647.
English Abstract of DE69910249.

* cited by examiner

CYLINDER HEAD FOR AN INTERNAL COMBUSTION ENGINE

The invention relates to a cylinder head for an internal combustion engine having liquid cooling, comprising at least two outlet valves for controlling outlet openings and at least one inlet valve for controlling at least one inlet opening per cylinder, having at least one cooling jacket through which cooling medium flows, wherein an outlet valve bridge is arranged between two adjacent outlet valves and a respective inlet/outlet valve bridge is arranged between at least one outlet valve and an adjacent inlet valve, and wherein a first cooling channel is arranged in the region of at least one outlet valve bridge and a second cooling channel is arranged in the region of at least one inlet/outlet valve bridge, and the first and second cooling channels are flow-connected to one another in a central cooling region of the cylinder.

AT 506 473 B1 describes a cylinder head for an internal combustion engine, comprising several cylinders with a coolant jacket surrounding the outlet valves, which has a coolant collection channel extending in the longitudinal direction of the cylinder head on the outlet side. Cooling channels are arranged in the area of the outlet valve bridge and in the region of the inlet/outlet valve bridges. Since the coolant flow takes place in the region of the cooling channel of the inlet/outlet valve bridge on either side of each outlet valve, flow stagnation and thus overheating can occur in the region of the inlet/outlet valve bridges and the outlet valve guides.

Internal combustion engines with exhaust gas collectors integrally formed with the cylinder heads are known from the publications US 2005/0087154 A1, EP 0 856 650 A1, U.S. Pat. No. 7,051,685 B2, AT 500 442 B1.

Particularly in the case of high-performance internal combustion engines, sufficient cooling of the region of the inlet/outlet valve bridges and the outlet valve guides is not ensured.

It is the object of the invention to improve the cooling in the region of the inlet/outlet valve bridges and in the region of the outlet valve guides.

According to the invention, this is achieved by at least one second cooling channel having a flow-dividing device which subdivides the second cooling channel at least in sections into a first partial channel and a second partial channel. Preferably, the first partial channel is arranged in the region of an outlet valve guide and the second partial channel is arranged in the region of an outlet valve seat of the adjacent outlet valve. This makes it possible to improve the cooling both in the region of the outlet valve guide and in the region of the outlet valve seat.

Preferably, the first partial channel and the second partial channel are merged both upstream and downstream of the flow-dividing device. In detail, it can be provided that the first and second partial channels are merged in the region of the first cooling channel. Furthermore, the first and the second partial channel can be merged in the region of a connecting channel of the cooling jacket, which is arranged in the region of a motor transverse plane between two adjacent cylinders or on at least one end face of the cylinder head. The connecting channel mutually connects two outlet-side and/or two inlet-side cooling jacket sections of two adjacent cylinders and/or at least one outlet-side cooling jacket section to an inlet-side cooling jacket section.

The flow division of the second cooling channel thus occurs essentially only in the region of the inlet/outlet valve bridge. The coolant flow in the region of the inlet/outlet valve bridge is thus divided into two partial streams, wherein the first partial flow through the first partial channel flows around the outlet valves and thus cools the corresponding outlet valve seat. The second partial flow of the second partial channel cools the transition region between inlet and outlet valves. The two partial channels allow a directed flow and point-precise cooling of regions of the inlet/outlet valve bridge, which are subjected to high thermal stress, and in particular the adjacent outlet valve seat.

In addition, or alternatively to the flow-dividing device, it can be provided according to the invention that the first cooling channel is flow-connected to the second cooling channel only via the central cooling region and at least one flow interruption device is arranged in a region diametrically opposite the first and/or second cooling channel with respect to the outlet valve centre. Flow interruption means both a complete interruption of the cooling channel, e.g. through a material entry or a cover device, as well as a throttling point or apparatus which interrupts the flow. It is particularly advantageous if the first cooling channel and at least one second cooling channel—preferably the first cooling channel and the first partial channel—together surround at least one outlet valve guide over an angular range between 180° and 300°, preferably about 210° to 240°. The second cooling channel is thus exposed by the flow interruption device in a region facing the outlet longitudinal side wall of the cylinder head, opposite the first cooling channel. Thus, a complete flow around the outlet valves is prevented. Thereby, it can be prevented that there is a bypass flow between first and second cooling channel of the coolant in the region of the outer side of the cylinder, and that stagnation and/or overheating occurs in the region of the second cooling channel. On account of the higher flow velocities, increased heat dissipation can be achieved from the area of the outlet valve guides on the one hand and an improved cooling of the outlet valve seats on the other hand.

The cylinder head can have an integrated coolant collecting channel extending at least over two cylinders and/or at least one integrated exhaust gas collector extending over at least two cylinders, which is at least partially surrounded by an exhaust gas cooling jacket. The first cooling channel of each cylinder can be connected to the coolant collecting channel and/or to the exhaust gas cooling jacket via at least one transfer channel. The main flow from or to the coolant collecting channel or coolant distribution channel and from or to the exhaust gas cooling jacket of the exhaust manifold takes place via the transfer channel connected to the first cooling channel.

The coolant can flow into the cooling jacket of the cylinder head via flow transfer openings in the area of the cylinder head plane from the cooling jacket of the cylinder block or flow into the cooling jacket of the cylinder block from the cooling jacket of the cylinder head, as is customary in the case of top down cooling systems.

The production effort can be kept extremely small when the flow-dividing device and/or the flow interruption device is formed by a cast wall section of the cylinder head. The flow-dividing device and the flow interruption device are thus formed by the casting material of the cylinder head itself, wherein only slight modifications of the casting mould or of the cast cores are necessary.

The heat dissipation from thermally highly stressed areas of the valve bridges, in particular of the inlet/outlet valve bridges, as well as of the outlet valve guides, can be significantly improved by the flow-dividing device and/or the flow interruption device, in particular in high-performance internal combustion engines.

The invention is explained in more detail below with reference to the non-limiting drawings, wherein.

Figure 1:
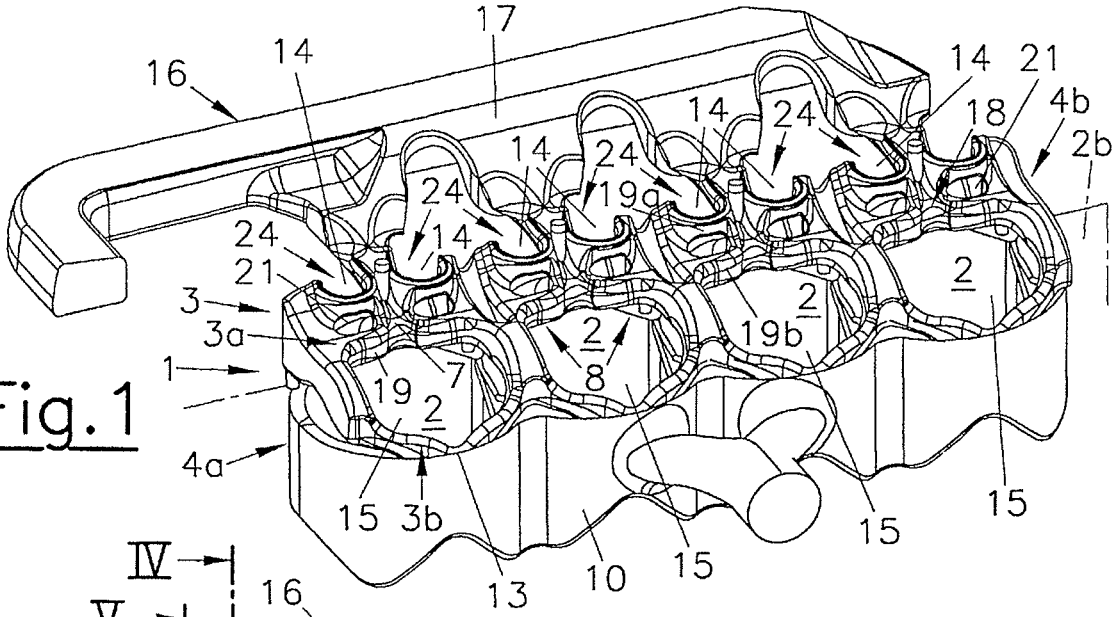
FIG. 1 shows a cooling jacket system of an internal combustion engine having a cylinder head according to the invention in an oblique view.
Figure 2:
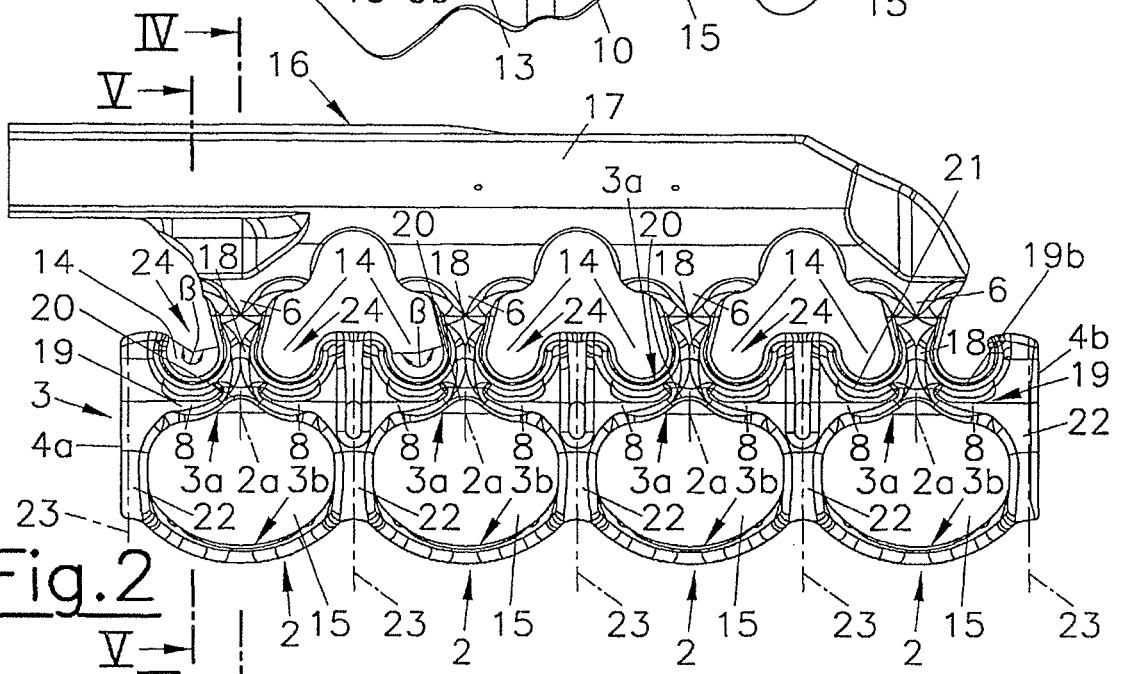
FIG. 2 shows a cooling jacket of a cylinder head according to the invention in a top view.
Figure 3:
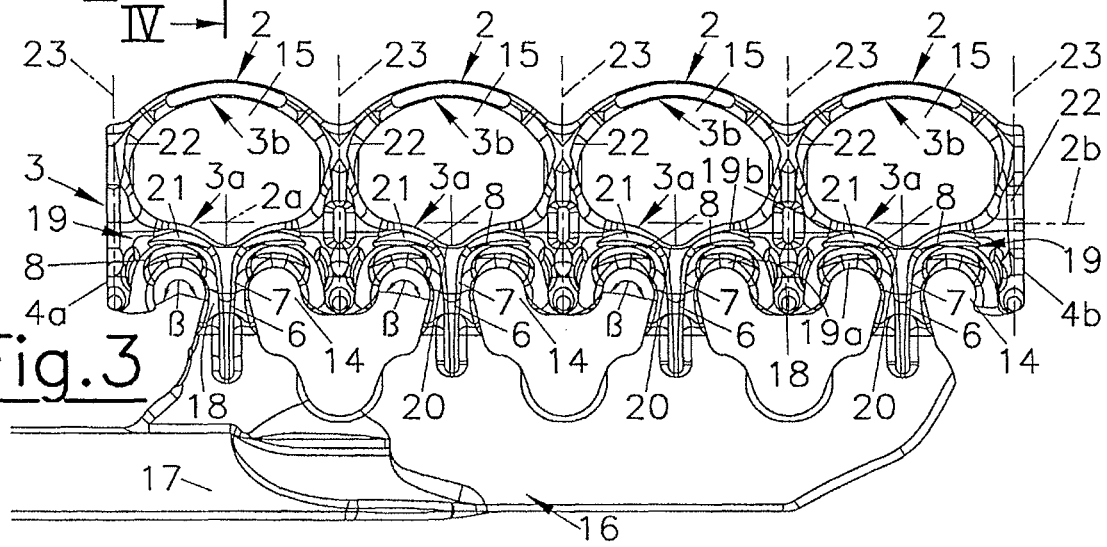
FIG. 3 shows the cooling jacket in a bottom view.
Figure 4:
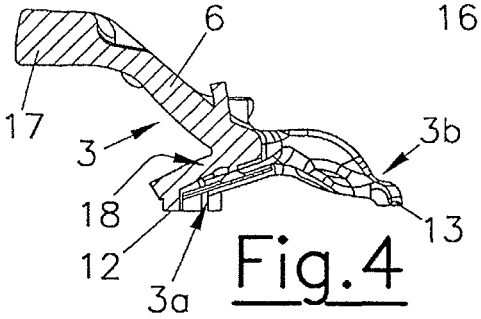
FIG. 4 shows the cooling jacket in a sectional view along the line IV-IV in FIG. 2.
Figure 5:
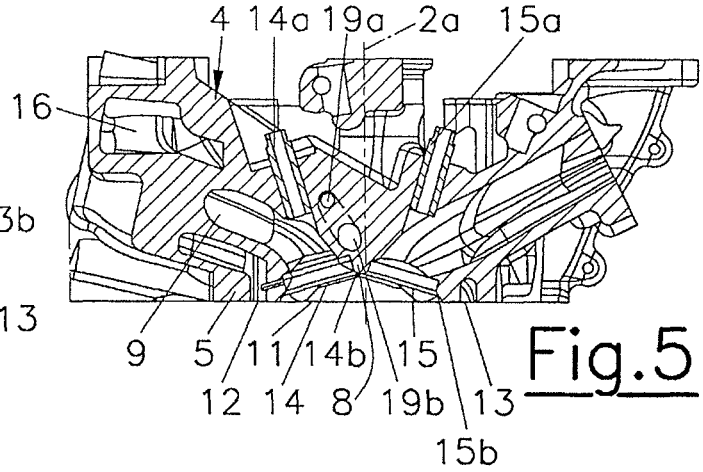
FIG. 5 shows a cylinder head according to the invention in a sectional view along line V-V in FIG. 2.
Figure 6:
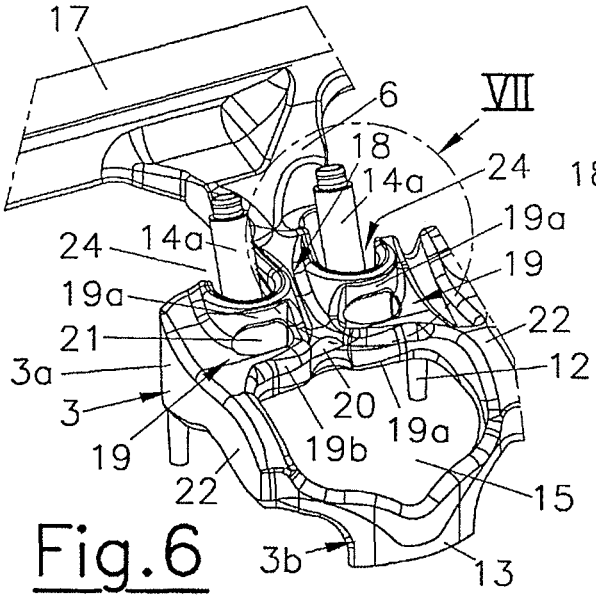
FIG. 6 shows the cooling jacket of a cylinder of the cylinder head according to the invention in an oblique view from above.
Figure 7:
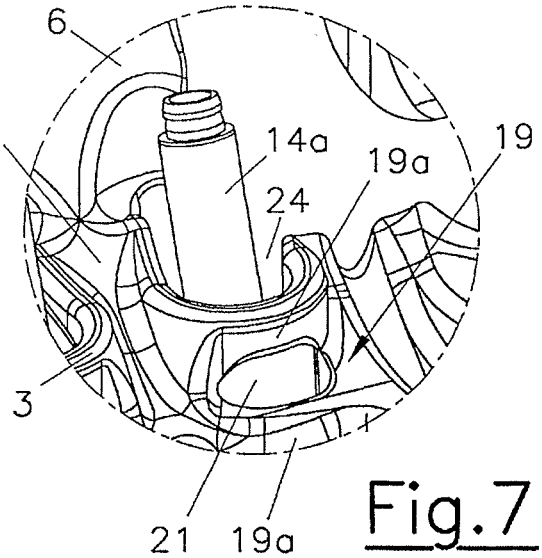
FIG. 7 shows the detail VII from FIG. 8.
Figure 8:
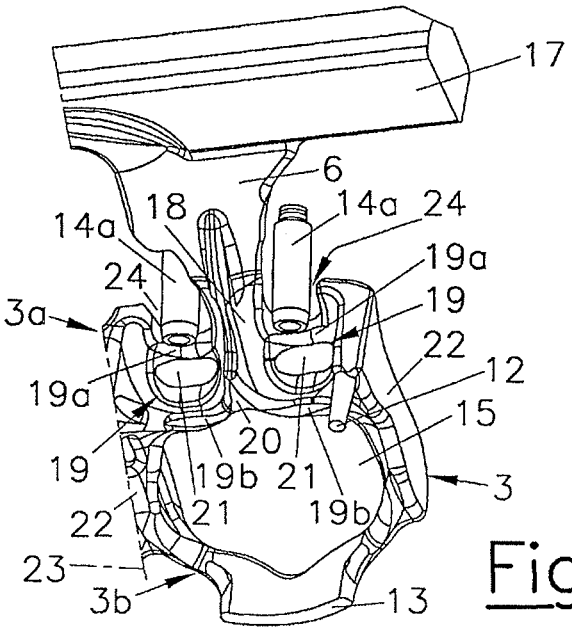
FIG. 8 shows the cooling jacket of a cylinder in an oblique view from below.

FIG. 1 shows a cooling jacket system 1 of an internal combustion engine with a plurality of cylinders 2, comprising a cooling jacket 3 of a cylinder head 4 for cooling thermally critical areas such as fire deck 5, valve guides 14*a*, 14*b*, valve seats 14*b*, 15*b*, exhaust valve bridges 7 between the outlet valves, inlet/outlet valve bridges 8 between inlet valves and outlet valves, outlet channels 9, etc (FIG. 5). The cooling jacket 3 of the cylinder head 4 is in flow connection with a block cooling jacket 10 of a cylinder block (not shown). In the area of the cylinder head sealing plane 11, there are outlet-side and/or inlet-side flow transfer openings 12, 13 for each cylinder 2 between the cooling jacket 3 of the cylinder head 4 and the block cooling jacket 10, as shown in FIG. 5. The cylinder head 4 has, for each cylinder 2, two outlet valves and two inlet valves, of which only the exposed areas 14 in the cooling jacket 3 are shown for the outlet openings or the exposed areas 15 in the cooling jacket 3 for the inlet openings, and—in FIG. 5—the outlet valve guides 14*a* and inlet valve guides 15*a* as well as outlet valve seats 14*b* and inlet valve seats 15*b*. The outlet valve guides 14*a* are also shown in FIGS. 6 to 8.

The cylinder head 4 has an integrated exhaust gas collector 16 (see FIG. 5), which is at least partially surrounded by an exhaust gas cooling jacket 17. The exhaust gas cooling jacket 17 is in flow connection with the cooling jacket 3 of the cylinder head 4 via a respective transfer channel 6 per cylinder 2, wherein the transfer channel 6 is connected per cylinder 2 to a first cooling channel 18 arranged between two outlet valve openings 14 in the region of the exhaust valve bridge 7. In the region of each of the inlet/outlet valve bridges 8 between an outlet valve and an inlet valve, a respective second cooling channel 19 is arranged, which is connected to the first cooling channel 18 in a central cooling region 20, i.e. close to the cylinder axis.

The cooling jacket 3 of the cylinder head 4 has an outlet-side cooling jacket section 3*a* and an inlet-side cooling jacket section 3*b* which are flow-connected to each other in the region of the motor transverse planes 23 between adjacent cylinders 2 and at the end faces 4*a*, 4*b* of the cylinder head 4 via connecting channels 22. In this case, the motor transverse plane 23 denotes a plane extending normally to the motor longitudinal plane 2*b* between adjacent cylinders 2, said motor longitudinal plane being defined by the cylinder axes 2*a*.

The second cooling channel 19 is designed to be divided in the region of each inlet/outlet valve bridge 8, wherein a first partial channel 19*a* and a second partial channel 19*b* are arranged on one respective side of a flow-dividing device 21. The flow-dividing device 21, which is designed in the shape of a crescent or kidney-shaped in a top view of the cylinder axis indicated by reference numeral 2*a*, thus divides the second cooling channel 19 into two partial channels, namely into a first partial channel 19*a* shown in FIG. 5 above the outlet channel 9, and a second partial channel 19*b* which is arranged in the drawings obliquely beneath the first partial channel 19*a*, wherein the partial channels 19*a*, 19*b* originate from the common flow path upstream of the flow-dividing device 21 and open again downstream of the flow-dividing device 21 into a common flow path. In this case, the first partial channel 19*a* is arranged in the form of a circular ring sector around the outlet valve guide 14*a*, as a result of which optimum cooling of the outlet valve guide is achieved. The second partial channel 19*b* is arranged in the region of the outlet valve seat 14*b*, which in a targeted manner removes heat from this region of the inlet/outlet valve bridge 8. The first and second partial channels 19*a*, 19*b* are combined on the one hand in the region of the first cooling channel 18 and on the other hand in the region of the adjacent connecting channel 22 of the cooling jacket 3. Each connecting channel 22 is designed so as to mutually flow-connect two outlet-side cooling jacket sections 3*a* and/or two inlet-side coolant sections 3*b* of two adjacent cylinders 2 and/or at least one outlet-side cooling jacket section 3*a* to an inlet-side cooling jacket section 3*b*.

The flow from the first cooling channel 18 into the second cooling channel 19 or from the second cooling channel 19 into the first cooling channel 18 takes place depending on whether a top-down cooling concept—with flow from the cooling jacket 3 of the cylinder head 2 into the block cooling jacket 10—or a conventional cooling concept with flow from the block cooling jacket 10 into the cooling jacket 3 of the cylinder head 2 is implemented. In this case, the flow occurs at least in the regions of the motor transverse planes 23 essentially transversely to the motor longitudinal plane 2*b* which is defined by the cylinder axes 2*a*.

In order to prevent stagnation of the flow in the second cooling channel 19, the first cooling channel 18 is flow-connected to the second cooling channel 19 only via the central cooling region 20, wherein, in a region of the cylinder head 2 which is diametrically opposite the first and/or second cooling channel 19 with respect to the outlet opening 14, a flow interruption device 24 is arranged (see FIGS. 6 to 8). In this case, the flow interruption device 24 is, for example, a blockage or interruption of a region of the second cooling channel 19 surrounding the outlet valves, or a connection of the first cooling channel 18 with the second cooling channel 19. Instead of an interruption or blockage, a throttling point or other types of flow interruptions can also be provided. The first cooling channel 18 and at least one second cooling channel 19—preferably the first cooling channel 18 and the first partial channel 19*a*—surround in combination the respective outlet valve guide 14*a* over an angular range β between 180° and 300°, preferably approximately 210° to 240°.

By means of the flow interruption device 24, bypass flows between the first cooling channel 18 and the second cooling channel 19 around the outlet valve on the side of the outlet valve guide 14*a* remote from the first cooling channel 18 can be avoided. Thus, in the region of every other second cooling channel 19, a defined radial flow occurs locally in the longitudinal direction of the motor at high speeds and throughputs.

The cooling in the region of the corresponding inlet/outlet valve bridge 8 can be improved both with the flow-dividing device 21 and also with the flow interruption device 24.

Particularly good heat dissipation can be achieved by combining the flow-dividing device 21 and the flow interruption device 24.

The invention claimed is:

1. A cylinder head for an internal combustion engine having liquid cooling, the cylinder head comprising:

at least two outlet valves configured and arranged to control outlet openings;

at least one inlet valve configured and arranged to control at least one inlet opening per cylinder, the at least one inlet valve including at least one cooling jacket through which cooling medium flows;

an outlet valve bridge is arranged between the at least two adjacent outlet valves;

at least one inlet/outlet valve bridge is arranged between at least one outlet valve and an adjacent inlet valve;

a first cooling channel is arranged adjacent the at least one outlet valve bridge;

a second cooling channel is arranged adjacent the at least one inlet/outlet valve bridge, and the first and second cooling channels are flow-connected to one another about an outlet valve guide, the first and second cooling channels configured and arranged to improve cooling in proximity to the inlet-outlet valve bridge and the outlet valve guide; and wherein the second cooling channel includes a flow-dividing device which subdivides the second cooling channel into a first partial channel and a second partial channel, each extending about a respective side of the outlet valve guide, and rejoining on a far side of the outlet valve guide.

2. The cylinder head according to claim 1, further including at least one flow interruption device arranged diametrically opposite the first and/or second cooling channel with respect to at least one of the outlet openings.

3. The cylinder head according to claim 1, wherein the first and second partial channels are merged both upstream and downstream of the flow-dividing device.

4. The cylinder head according to claim 1, wherein the first partial channel and the second partial channel are merged adjacent the first cooling channel.

5. The cylinder head according to claim 1, wherein the first partial channel and the second partial channel are merged adjacent a connecting channel of the at least one cooling jacket, the at least one cooling jacket is arranged adjacent a motor transverse plane between two adjacent cylinders and/or adjacent at least one end face of the cylinder head.

6. The cylinder head according to claim 5, wherein a flow through the connecting channel connects two outlet-side cooling jacket sections and/or two inlet-side cooling jacket sections of the cooling jacket of two adjacent cylinders to each other.

7. The cylinder head according to claim 5, wherein a flow through the connecting channel connects at least one outlet-side cooling jacket section of the at least one cooling jacket to an inlet-side cooling jacket section to each other.

8. The cylinder head according to claim 1, further including an integrated coolant collecting channel extending at least over two cylinders and/or at least one integrated exhaust gas collector extending over at least two cylinders which is at least partly surrounded by an exhaust gas cooling jacket, and wherein the first cooling channel of each cylinder is connected to the coolant collecting channel and/or the exhaust gas cooling jacket.

9. The cylinder head according to claim 1, wherein the first cooling channel and the second cooling channel together surround the outlet valve guide over an angular range between 180° and 300°.

10. The cylinder head according to claim 1, wherein the flow-dividing device and/or the flow interruption device is formed by a cast wall section of the cylinder head.

11. The cylinder head according to claim 8, wherein the first cooling channel of each cylinder is connected to the coolant collecting channel and/or the exhaust gas cooling jacket via at least one transfer channel.

12. The cylinder head according to claim 9, wherein the first cooling channel and the first partial channel of the second cooling channel together surround the outlet valve guide over an angular range between 180° and 300°.

13. The cylinder head according to claim 9, wherein the first cooling channel and the second cooling channel together surround the outlet valve guide over an angular range between 210° to 240°.

14. The cylinder head according to claim 13, wherein the first cooling channel and the first partial channel of the second cooling channel together surround the outlet valve guide over an angular range between 210° to 240°.

15. The cylinder head according to claim 1, wherein the first partial channel is arranged in the region of the outlet valve guide and the second partial channel is arranged in the region of an outlet valve seat of the adjacent outlet valve.

16. A cylinder head for an internal combustion engine having liquid cooling, the cylinder head comprising:

at least two outlet valves configured and arranged to control outlet openings;

at least one inlet valve configured and arranged to control at least one inlet opening per cylinder, the at least one inlet valve including at least one cooling jacket through which cooling medium flows;

an outlet valve bridge is arranged between two of the at least two adjacent outlet valves;

an inlet/outlet valve bridge is arranged between at least one outlet valve of the at least two outlet valves and an adjacent inlet valve of the at least one inlet valve;

and the first and second cooling channels are flow-connected to one another and configured and arranged to improve cooling in proximity to the inlet-outlet valve bridge and the outlet valve guide; and and at least one flow interruption device is arranged diametrically opposite the first and/or second cooling channel with respect to one of the outlet openings.

17. The cylinder head according to claim 16, wherein the second cooling channel includes a flow-dividing device which subdivides the second cooling channel into a first partial channel and a second partial channel.

18. The cylinder head according to claim 17, wherein the first partial channel is arranged in the region of the outlet valve guide and the second partial channel is arranged in the region of an outlet valve seat of the adjacent outlet valve.

19. The cylinder head according to claim 16, wherein the flow-dividing device and/or the flow interruption device is formed by a cast wall section of the cylinder head.

* * * * *